United States Patent [19]

Lobbe

[11] 4,198,098

[45] Apr. 15, 1980

[54] MINERAL WINNING INSTALLATIONS

[75] Inventor: Armin Löbbe, Oberaden, Fed. Rep. of Germany

[73] Assignee: Gewerkschaft Eisenhutte Westfalia, Lunen, Fed. Rep. of Germany

[21] Appl. No.: 950,839

[22] Filed: Oct. 12, 1978

[30] Foreign Application Priority Data

Nov. 16, 1977 [DE] Fed. Rep. of Germany ..... 2751199

[51] Int. Cl.[2] ..... E21C 27/40

[52] U.S. Cl. ..... 299/34; 299/81

[58] Field of Search ..... 299/17, 32, 34, 81, 299/42

[56] References Cited

U.S. PATENT DOCUMENTS

| | | | |
|---|---|---|---|
| 54,833 | 5/1866 | Locke et al. | 299/42 X |
| 3,132,852 | 5/1964 | Dolbear | 299/17 X |
| 3,273,940 | 9/1966 | Belugou | 299/81 |
| 3,887,235 | 6/1975 | Koppers | 299/17 X |
| 3,904,244 | 9/1975 | Haspert | 299/34 |

FOREIGN PATENT DOCUMENTS

| | | | |
|---|---|---|---|
| 1215630 | 5/1966 | Fed. Rep. of Germany | 299/34 |
| 2365281 | 7/1974 | Fed. Rep. of Germany | 299/17 |

*Primary Examiner*—Ernest R. Purser

*Attorney, Agent, or Firm*—Thompson, Birch, Gauthier & Samuels

[57] ABSTRACT

A mineral winning installation employs a plurality of plough bodies spaced apart along the mineral face and interconnected to form a common plough train which is moved in unison back and forth along the face. The plough bodies have high-pressure fluid emission nozzles and a high-pressure pipe line extending between the bodies supplies high pressure fluid to the nozzles, which discharge the fluid for impact with the mineral face.

14 Claims, 2 Drawing Figures

MINERAL WINNING INSTALLATIONS

BACKGROUND OF THE INVENTION

The present invention relates in general to mineral winning installations and especially, but not solely, to coal-winning installations.

In longwall coal face workings, it is well known to utilize a plough which is moved back and forth alongside the coal face and which is supported and guided by guide means mounted on a scraper-chain conveyor. Usually, the motive force is supplied to the plough by means of a chain which runs in guide channels formed in the guide means. It is also known to equip the plough with low-pressure water emission nozzles for dust depression purposes. U.S. Pat. No. 3,861,751 describes a plough construction of this known type.

To extract coal, particularly in a short face working or head gallery, it is also known to adopt the so-called hydraulic method of winning, where high pressure jets of water impact of the coal face. German Pat. No. 2,307,413 and U.K. Pat. No. 672,336 describe known forms of hydraulic winning installations. Normal cutting tools can operate in addition to the high pressure water jets. Problems can occur in winning coal by water jets from thin and/or faulty seems where the relatively soft coal is interspersed with harder rock and the supply of high pressure water to the nozzles sometimes pressure difficulties.

A general object of this invention is to provide an improved installation for efficient winning of minerals, particularly coal, with high pressure fluid jets.

SUMMARY OF THE INVENTION

In accordance with the invention, an improved mineral mining installation employs several plough bodies, each equipped with nozzles for emitting high-pressure water or fluid jets and arranged as a plough train, movable in relation to the associated mineral face. All or some of the plough bodies may also have normal cutting tools so that the mineral or coal is stripped by a combination of hydraulic and mechanical working.

By utilizing a number of plough bodies spaced-apart along the mineral or coal face and interconnecting the bodies to move in unison back and forth along the face, the strokes of movement can be short in relation to the length of the face and the strokes can be somewhat greater than the spacing between the bodies ensuring the efficient winning of the mineral or coal. With a typical spacing between adjacent bodies of 5 meters, the stroke of motion of the train can be about 6 meters. The simple reciprocal motion of the plough train with short strokes ensures that a much simplified drive system can be employed. Such a drive system can be in the form of one or more double-acting hydraulic units. In addition, the supply of high-pressure fluid, usually water, to the individual bodies can be simplified by utilizing a common high-pressure pipe line linking the bodies together. This main high-pressure line can serve to connect the bodies together and thus imparts the motive force to the bodies. Alternatively, a flexible driving member, such as a chain or articulated bars, may serve to impart the motive force to the plough bodies.

A common source or pump can supply high-pressure fluid to all the nozzles of the plough bodies via the aforementioned pipe line. The pump can be carried on the plough train, e.g. on one of the plough bodies, or arranged at one end of the mine working and connected via a flexible hose or the like to the main pipe line.

Although the main pipe line can serve to connect the bodies together and to guide the bodies during the motion thereof, it is desirable to support and guide the plough train on separate guide means extending along the mineral face. The guide means can be conveniently mounted to one side of a scraper-chain conveyor in known manner. The conveyor and plough train can then be shifted up in stages to follow the winning progress and to facilitate this, it is desirable to make the high-pressure line at least partly flexible. In this construction, the high-pressure line can be accommodated in a protective guide channel of the guide means. Preferably, the end faces of the plough bodies have a ramp like profile to load material into the conveyor. The aforementioned flexible driving member can also be accommodated in another guide channel of the guide means. Although the guide means would normally be mounted to the mineral-face side of the conveyor, it is possible to arrange the guide means on the opposite goaf side in which case the bodies may have base or sword plates extending beneath the conveyor. Instead of mounting the guide means to a conveyor, the guide means can be mounted to some other structure of the installation, such as to the roof bars of support chocks.

The guide means can employ several guide channels, each accommodating a high-pressure fluid line supplying fluid to a group of plough bodies.

As mentioned previously, mechanical cutting tools can also be employed on the plough train. It is possible for some of the plough bodies to have only mechanical cutting tools and the remainder of the bodies to have the nozzles for emitting the high-pressure fluid jets.

It is possible also to provide several plough trains for one longwall coal face with each train just acting on one region of the overall face. Conversely, a single plough train can act just on one region of the coal face, say in the stable hole region or over a region where the seam is faulty and mechanical extraction is difficult. In this case, conventional techniques can be used to strip coal from the other remaining regions of the face and the pressure of the fluid jets emitted by the plough bodies and impacting with the faulty seam can be over 1000 bars.

The individual plough bodies of the plough train according to the invention can be of simple basic design with a particularly compact size of minimal height, making the train especially suitable for use with thin mineral seams.

The invention may be understood more readily and various other aspects and features of the invention may become apparent from consideration of the following description.

BRIEF DESCRIPTION OF DRAWING

Embodiments of the invention will now be described, by way of examples only, with reference to the accompanying drawing, wherein.

DESCRIPTION OF PREFERRED EMBODIMENTS

Figure 1:
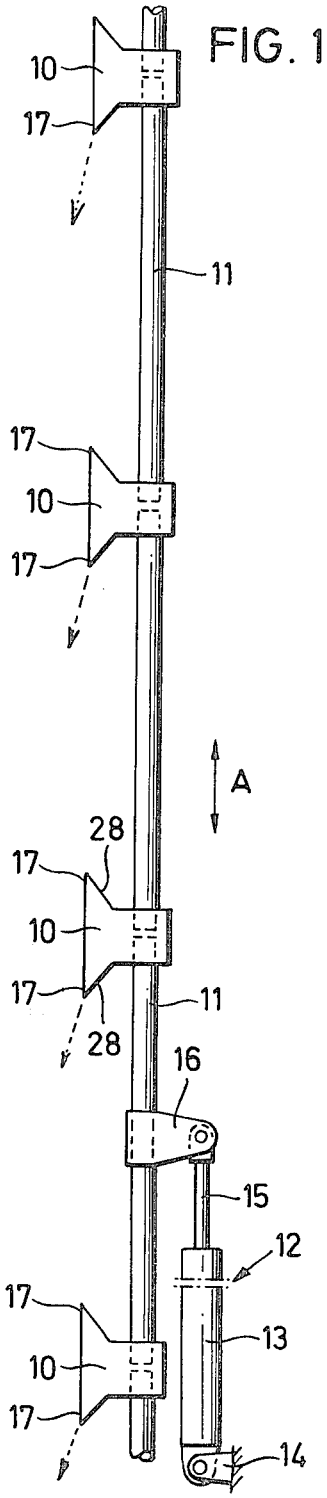
FIG. 1 is a schematic plan view of part of a mineral winning installation constructed in accordance with the invention.

The mineral winning installation depicted in FIG. 1 of the accompanying drawing employs winning apparatus in the form of a plurality of separate winning plough bodies 10. The bodies 10 are interconnected by means of conduit or pipe means 11, serving to convey high-pressure fluid to the bodies 10. The pipe means 11 can take the form of individual pipe sections, each connected between a pair of plough bodies 10. The pipe means 11 and the bodies 10 are reciprocated back and forth alongside a coal face in the directions of arrows A. To impart this drive motion to the structure 10, 11, drive means 12 is provided. This drive means 12 can take the form of a hydraulic double-acting piston and cylinder unit 13. As shown, the unit 13 has its cylinder mounted on a support 14, conveniently at one end of the coal face working, and its piston rod 15 connected to the pipe means 11 via a coupling member 16.

Each body 10 has a plurality of jets or nozzles 17 which emit fluid under high-pressure for impact with the coal face. Each body 10 can have several sets of nozzles 17 emitting fluid at different levels and/or angles. A pump (not shown) supplies high-pressure fluid to the pipe means 11 and thence to the nozzles 17. The high pressure fluid is conveniently water at a pressure of at least 500 bars and, preferably, 700 bars or more. The pump can be located near the drive means 12 at one end of the working. Preferably, the pump is connected to the pipe means 11 through a flexible hose permitting the reciprocal motion of the pipe means 11. The structure 10,11 forming a plough train is guided by guide means arranged on a longwall conveyor or on roof supports, e.g. on the roof bars thereof.

Figure 2:
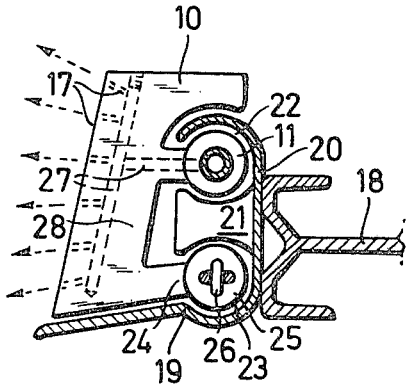
FIG. 2 is a cross-sectional view of part of another installation constructed in accordance with the invention.

FIG. 2 depicts a further installation made in accordance with the invention. This installation has guide means arranged on the coal-face side of scraper-chain conveyor 18. The guide means comprises angle plates 19 with lower foot regions engaging beneath a plurality of separate plough bodies 10 (c,f FIG. 1), and upstanding portions 20 connected to the respective conveyor pans. Spacers 21 are fitted to the upstanding portions 20 of the angle plates 19 to define upper and lower guide channels 22, 23. The individual bodies 10 each have rearwardly-extending projections engaging into the guide channels 22,23. The lower projections 24 of the bodies 10 extending into the lower channels 23 connect with guide blocks 25, coupled together with a chain 26. The chain 26 thus connects the bodies 10 together and the chain 26 is driven back and forth by drive means similar to FIG. 1, but preferably comprising units 13 at both ends of the working. The upper channel 22 accommodates a high-pressure pipe line 11. Instead of imparting the drive motion to the plough train with the chain 26, it is possible to utilize the pipe line 11, as in the FIG. 1 embodiment. In this case, the lower channel 23 and associated parts can be omitted. Where the pipe line 11 is used to impart the drive force directed generally longitudinally of the pipe line 11, it is desirable to employ an armoured pipe line preferably made up of sections in the manner of the FIG. 1 embodiment. To facilitate the shifting of the conveyor 18 in sections in known manner, it is preferable also to have the pipe line 11 at least partly flexible in the transverse direction. Each body 10 in the FIG. 2 embodiment again employs a plurality of nozzles 17 for emitting high-pressure fluid to win the coal. The fluid is conveyed to the nozzles 17 via the pipe line 11 and via channels 27 in the bodies 10. It is also possible to modify the installation so that additional guide channels, similar to 22,23 are provided. These additional channels may then also accommodate further high-pressure lines so that high-pressure fluid is supplied to each body 10 through several pipe lines. The end faces 28 of the plough bodies 10 may have a ramp-like profile resembling a plough share to load the detached coal or mineral into the conveyor 18 as the plough train moves back and forth.

In the embodiments of the invention, it is desirable to utilize about five to ten bodies 10 in the plough train and to have the adjacent bodies 10 spaced apart by about 3 to 8 meters. The stroke of the reciprocal drive is then made somewhat longer than the spacing between the bodies 10.

It is possible to provide additional cutting tools on the plough bodies 10 so that each body 10 wins coal or mineral by a combination of hydraulic and mechanical action.

Although the fluid would normally be supplied at a pressure in the range specified above, in the case of very hard coal seams or where rock is interspersed with a mineral seam, a much higher pressure, say 1500 bars, can be adopted, which will ensure that even hard rock is detached and abraded.

In a further modification, the high-pressure fluid pump or pumps supplying the fluid or water to the pipe line or pipe lines 11 and thence to the nozzles 17 of the plough bodies 10 can be carried on the plough train itself so that it is moved to and fro with the plough train.

I claim:

1. A mineral winning installation comprising a plurality of separable plough bodies spaced-apart alongside a mineral face, nozzles for emitting a high-pressure fluid from each of said plough bodies and means for moving the bodies in unison back and forth alongside the mineral face with each body only acting over a region of the mineral face.

2. A mineral winning installation for extracting or winning mineral from an underground mineral face; said installation comprising a plough train composed of a plurality of individual, spaced apart interconnected plough bodies, at least some of which are equipped with high-pressure fluid emission nozzles for directing high-pressure fluid against the mineral face and means for moving the plough train back and forth in relation to the mineral face with each body only acting over a region of the mineral face.

3. An installation according to claim 2, wherein the bodies are interconnected at least by means of a high-pressure line supplying the high-pressure fluid to the nozzles thereof.

4. An installation according to claim 3, wherein the high-pressure line is at least partly flexible.

5. An installation according to claim 3, wherein the high pressure line is made from sections each extending between an adjacent pair of said bodies.

6. An installation according to claim 3, and further comprising guide means for guiding and supporting the plough bodies.

7. An installation according to claim 6, wherein the guide means defines a channel accommodating the high-pressure line.

8. An installation according to claim 7, wherein the guide means defines a further channel accommodating a flexible driving member connecting the plough bodies together and the means for moving the plough train imparts the motive force to the driving member.

9. An installation according to claim 6, wherein the guide means is mounted on the side wall of a scraper-chain conveyor,

10. An installation according to claim 9, wherein the plough bodies have ramp-like end faces for loading material into the conveyor.

11. An installation according to claim 3, wherein the means for moving the plough train imparts the motive force to the high-pressure line.

12. An installation according to claim 2, wherein at least some of the plough bodies have cutting tools known per se, for attacking the mineral face.

13. An installation according to claim 2, wherein the motion of the plough train is somewhat larger than the spacing between the plough bodies so that said regions overlap.

14. A mineral winning installation for winning mineral from a longwall mineral face; said installation comprising a series of individual plough bodies spaced-apart along the mineral face, high-pressure fluid emission nozzles provided on each of the plough bodies, means for supplying high-pressure fluid to the nozzles of the plough bodies, means, at least partly including said fluid supply means, interconnecting the plough bodies as a plough train for common reciprocal movement back and forth along the face and means for effecting said reciprocal movement in strokes greater than the spacing between the plough bodies so that each plough body wins mineral over a short region of the longwall face with the associated regions overlapping to ensure the plough train wins mineral over the length of the longwall face.

* * * * *